US007741254B2

(12) United States Patent
Billiet et al.

(10) Patent No.: US 7,741,254 B2
(45) Date of Patent: Jun. 22, 2010

(54) HIGH DENSITY MATERIALS WITH INTRINSIC UNABRADABLE SLIPPERINESS AND METHOD OF FABRICATION THEREOF

(76) Inventors: Romain L. Billiet, 26 LoRong Susu, Penang (MY) 10400; Hanh T. Nguyen, 26 LoRong Susu, Penang (MY) 10400

( * ) Notice: Subject to any disclaimer, the term of this patent is extended or adjusted under 35 U.S.C. 154(b) by 421 days.

(21) Appl. No.: 11/894,095

(22) Filed: Aug. 21, 2007

(65) Prior Publication Data

US 2009/0054275 A1 Feb. 26, 2009

(51) Int. Cl.

| | |
|---|---|
| ***F16C 33/20*** | (2006.01) |
| ***C01B 35/00*** | (2006.01) |
| ***C01B 35/14*** | (2006.01) |
| ***C01B 21/064*** | (2006.01) |

(52) U.S. Cl. ..... 508/100; 423/290; 423/284; 423/276

(58) Field of Classification Search ..... 508/100; 423/290, 284, 276

See application file for complete search history.

(56) References Cited

U.S. PATENT DOCUMENTS

| | | | | |
|---|---|---|---|---|
| 4,927,461 | A | 5/1990 | Ciloglu et al. | |
| 5,589,443 | A | 12/1996 | Denton et al. | |
| 5,985,802 | A | 11/1999 | Watari et al. | |
| 6,306,358 | B1 | 10/2001 | Yamamoto | |
| 6,465,089 | B2 * | 10/2002 | Niwa et al. | 428/323 |
| 6,576,598 | B2 | 6/2003 | Brown | |
| 6,733,703 | B2 | 5/2004 | Billiet et al. | |
| 6,740,287 | B2 | 5/2004 | Billiet et al. | |
| 6,837,915 | B2 | 1/2005 | Dunmead et al. | |
| 7,128,962 | B2 | 10/2006 | Braillard et al. | |

OTHER PUBLICATIONS

Pickens, E.B., Trice, R.W.: Pressureless Sintering of $Si_3N_4$/BN Laminate Composites. Journal of Mat. Sc. vol. 40, 2005, pp. 2101-2103.

Benko, E.: Reaction of Regular BN With Selected Materials, . . . Tech. Report #79, 1988._Inst. of Adv.Mfg-Technology.

Hagio, T. et al.: Sintering of the Mechanochemically Activated Powders of h-BN_Journ. Am. Cer. Soc—vol. 72, No. 8, Aug. 1989.

Chou, T.C. et al.: Interfacial Reaction of BN/$Ni_3Al$ Appl. Phys. Lett., vol. 53, 155.16, Oct. 17, 1988, Am. Inst. of Physics.

Cherubini, J.H. et al.: $ZrB_2$, BN and $B_4C^1$ Compatibility With Austenitic Stainless Steel—ORNL Report 59-7-1, Jul. 31, 1959.

Lelonis, D. A. et al.: A High Performance Alternative for Solid Lubrication—Publication No. 81506(Sep. 2003) GE Advanced Ceramics.

* cited by examiner

*Primary Examiner*—Walter D Griffin
*Assistant Examiner*—Frank C Campanell

(57) ABSTRACT

Pressureless sintered high density materials containing hexagonal boron nitride have low coefficients of friction and high wear resistance and are useful for bearings, bushings and other articles subjected to bearing loads.

14 Claims, No Drawings

HIGH DENSITY MATERIALS WITH INTRINSIC UNABRADABLE SLIPPERINESS AND METHOD OF FABRICATION THEREOF

CROSS-REFERENCE TO RELATED APPLICATIONS

Not Applicable

REFERENCES CITED

U.S. Patent Documents

| | | | |
|---|---|---|---|
| 4,927,461 | May 1990 | Ciloglu et al. | 75/254 |
| 5,589,443 | December 1996 | Denton et al. | 508/180 |
| 5,985,802 | November 1999 | Watari et al. | 508/155 |
| 6,306,358 | October 2001 | Yamamoto | 423/290 |
| 6,576,598 | June 2003 | Brown | 508/118 |
| 6,733,703 | May 2004 | Billiet et al. | 264/40.1 |
| 6,740,287 | May 2004 | Billiet et al. | 264/669 |
| 6,837,915 | January 2005 | Dunmead et al. | 75/231 |
| 7,128,962 | October 2006 | Braillard et al. | 428/141 |

OTHER PUBLICATIONS

Pickens, E. B., Trice, R. W.: Pressureless sintering of silicon nitride/boron nitride laminate composites. Journal of Materials Science, Vol. 40, 2005, pp. 2101-2103.

Benko, E.: Reaction of regular boron nitride with selected materials: thermodynamic, structural, morphological and practical aspects. Abstract of Technical Report no. 79, 1988, The Institute of Advanced Manufacturing Technology, Cracow, Poland.

Hagio, T., Kobayashi, K., Yoshida, H., Yasunaga, H., Nishikawa, H.: Sintering of the Mechanochemically Activated Powders of Hexagonal Boron Nitride. Journal of the American Ceramic Society, Vol. 72, No. 8, August 1989.

Chou, T. C.: Interfacial Reaction of BN/$Ni_3Al$. Applied Physics Letters, Vol. 53, Issue 16, Oct. 17, 1988, American Institute of Physics.

Cherubini, J. H.; Leitten, C. F. Jr.: Zirconium Diboride, Boron Nitride, and Boron Carbide Compatibility with Austenitic Stainless Steel, ORNL Technical Report No. 59-7-1, Jul. 31, 1959, Oak Ridge National Laboratory.

ASM Handbook, Volume 3, Alloy Phase Diagrams, ASM International, ISBN 0-87170-381-5

Lelonis, D. A., Tereshko, J. W., Andersen, C. M.: Boron Nitride Powder—A High-Performance Alternative for Solid Lubrication. Publication No. 81506 (9/03), GE Advanced Ceramics, Momentive Performance Materials, Inc.

PhaseDiagram—Web, Interactive Phase Diagrams and Search Engine, Centre for Research in Computational Thermochemistry (CRCT), Ecole Polytechnique de Montreal. (http://www.factsage.com)

STATEMENT REGARDING FEDERALLY SPONSORED RESEARCH OR DEVELOPMENT

Not Applicable

REFERENCE TO A MICROFICHE APPENDIX

Not Applicable

BACKGROUND

1. Field of Invention

The present invention relates to a method for producing high density materials with intrinsic, unabradable slipperiness and, more particularly, materials having low coefficients of friction and wear rates and containing hexagonal boron nitride.

2. Description of Prior Art

Friction, defined in the context of this invention as the resistance to movement of one solid body over another, is essential to the proper course of many physical, biological and industrial processes. In a vast number of situations however, it is disadvantageous, resulting in loss of power, generation of heat and wear of the surfaces in contact. Consequently, wherever friction constitutes a problem, the prior art has endeavored to lower the coefficient of friction of the surfaces in relative motion to one another.

In one approach, a film of fluid lubricant is interposed between the moving surfaces. While traditional fluid lubricants such as vegetable and mineral oils, greases and animal fats still hold their place in many modern industrial applications, they do not possess the properties necessary to effectively function as engine lubricants, transmission fluids, gear oils, hydraulic and metalworking fluids and other high performance lubricants. Also, new high performance lubricant formulations are constantly required to overcome the shortcomings of existing products and to meet the demands of advancing technology. A significant example is the development of inorganic solid lubricants for applications involving severe temperatures, pressures and environments which would preclude the use of organic fluids.

Solid lubrication is based on ductile shear within a solid lubricant film caught between moving surfaces. Consequently, solid lubricants must have low shear strength, a property they share with fluid lubricants. The most widely used solid lubricants, graphite and molybdenum disulfide, as well as a number of other dichalcogenides provide this property through slip along preferred crystallographic planes. Solid lubricants should also have low abrasivity, i.e. they should be softer than the surfaces they lubricate to avoid causing abrasive wear to the latter. Finally, they should be thermodynamically and chemically stable in the environment in which they are to function. Yet, all of the solid lubricants mentioned so far suffer thermal decomposition or oxidative degradation at temperatures above 500-600° C. In addition, graphite is electrically conductive and reactive with ferrous alloys. To transcend these limitations, the prior art has turned to hexagonal boron nitride (h-BN).

Hexagonal boron nitride (h-BN) powder is synthesized by nitridation or ammonolysis of boron trioxide at temperatures ranging from 800° C. to 2000° C. During h-BN powder synthesis, edge-fused six-atom $(B—N)_3$ hexagonal rings crystallize into two-dimensionally-stacked layers of h-BN macromolecules. Different crystalline structures can be obtained by changing process conditions. During the initial stage of crystallization, from 800° C. to about 1200° C., h-BN macromolecules grow into hexagonal primary crystallites of approximately 10 nm width termed turbostratic boron nitride (t-BN).

During the next step of the crystallization process, from about 1200° C. to about 1800° C., the crystallites coalesce, roughly tripling their size to about 30 nm into so-called mesographitic boron nitride (m-BN). During the final stage of crystallization, from about 1800° C. to 2000° C. the crystallites again roughly triple their size to about 90 nm, arranging themselves into regularly stacked layers with the B atoms in the rings in one layer above and below N atoms in the rings of contiguous layers in what is called graphitic or fully crystallized hexagonal boron nitride (h-BN). It will be noted that the term hexagonal boron nitride (h-BN) is ambiguous as it is used to designate both the generic hexagonal crystalline structure of boron nitride—as distinct from other crystalline structures such as cubic boron nitride (c-BN)—as well as the fully crystallized graphitic boron nitride.

In the stacked layer arrangement of hexagonal boron nitride (h-BN), the polar interplanar B—N bond between adjacent layers is longer and therefore weaker than the strong covalent intraplanar B—N bonds in the fused six-atom rings. As a result, h-BN crystal grains are easily cleft into flakes liable to slip relative to one another, hence exhibiting solid lubricity. Hexagonal boron nitride (h-BN) is useful as both a low temperature and high-temperature solid lubricant or in applications where the electrical conductivity or chemical reactivity of graphite would constitute a problem. Like other solid lubricants, h-BN films are commonly applied by burnishing, thermal spraying, electrodeposition, chemical or physical vapor deposition.

Hexagonal boron nitride powders have also found use in fluid film lubrication. Denton et al., U.S. Pat. No. 5,589,443 teaches an h-BN-filled grease composition for lubricating journal bearings in rock bits used for oil well drilling. Watari et al., U.S. Pat. No. 5,985,802 discloses a high-performance cutting or grinding oil containing a dispersion of fine h-BN powders.

In another use of h-BN toward reducing the coefficient of friction, the prior art has resorted to various coatings and treatments of the surfaces in relative motion to one another. In one such instance, Brown, U.S. Pat. No. 6,576,698 teaches surface coatings for firearm projectiles and firearm components such as gun barrels composed of thermosetting resins filled with fine h-BN particles.

In cases where neither solid lubricant films nor surface treatments are indicated to lower the coefficient of friction of surfaces in relative motion to one another, the prior art has endeavored to replace the system components displaying excessive friction with components made from materials having an intrinsic lower coefficient of friction. For example, in replacement of the lead-containing aluminum and copper alloys used by the prior art for journal bearings and bushings and other articles subject to high bearing loads, Dunmead et al., U.S. Pat. No. 6,837,915, (Dunmead) teaches hot isostatically processed, lead-free, high theoretical density, h-BN-containing metal alloys having low coefficients of friction and wear rates. Dunmead claims that the amount of h-BN needed to result in a reduction of at least 20% of the coefficient of friction concomitant with a reduction of not more than 10% of the yield strength of the boron nitride-free matrix material is 2-5 weight percent. Metals amenable to Dunmead's invention include iron, carbon steel, stainless steel, chromium, aluminum, copper, brass, bronze and other copper based alloys. While Dunmead's invention constitutes a major improvement over the prior art in providing high density, wear-resistant materials with low coefficients of friction—thereby obviating the recourse to circuitous techniques such as fluid lubrication or surface treatments—materials amenable to his invention are limited to hot isostatically processable metallic alloys. Also, hot isostatic pressing, being a cost-intensive process, is generally uneconomical for mass production and frequently necessitates secondary machining if the shapes of the end products are somewhat complex.

Consequently, the prior art has turned to pressureless sintering. However, attempts at pressureless sintering of either pure h-BN or h-BN dispersed in a matrix have been largely unsuccessful due to boron nitride's reluctance to sinter as a result of the strong covalent bonds on the crystal basal planes.

For instance, Hagio et al., in the above cited reference, describes pressureless sintering of cold-pressed compacts of pure h-BN powders at 2000° C. for 1 hour without achieving any densification at all.

Likewise, Pickens et al., in the above cited reference, reports on pressureless sintering of cold-pressed structures composed of alternating layers of silicon nitride and boron nitride at 1800° C. for 3 hours resulting in poor densification with ensuing inferior mechanical properties.

Ciloglu et al., U.S. Pat. No. 4,927,461 (Ciloglu) discloses pressureless sintering of ferrous powder metallurgy (P/M) compacts containing h-BN powder. However, Ciloglu only aims at improving machinability and, therefore, the amount of h-BN powder added to the ferrous matrix is infinitesimal, from 0.01 to 0.5 weight percent, i.e. far below Dunmead's aforementioned optimum 2-5 weight percent necessary to reduce the coefficient of friction by at least 20%. Significantly, Ciloglu's matrix is a typical ferrous P/M powder with a maximum particle size of 300 μm.

Braillard et al., U.S. Pat. No. 7,128,962 (Braillard) claims pressureless partial sintering of materials containing 10-40 volume percent of boron nitride agglomerates having an equivalent diameter of 5-200 μm with, the explicit intention of rendering the resulting matrix composite abradable. Braillard emphatically excludes any alloys containing nickel on the grounds of severe incompatibility between nickel and boron. This inherently eliminates a large number of stainless steels and superalloys from the reach of his invention. Significantly, Braillard's metal matrix alloy powder has a particle size range of 10-70 μm.

Cherubini et al., (Cherubini) in the above cited reference, reports on attempts to pressureless sinter cold-pressed compacts of minus 100 mesh (149 μm) type 304 stainless steel powder blended with minus 325 mesh (44 μm) boron nitride powder resulting in precipitation of a boron-rich phase throughout the stainless steel matrix.

Chou, T. C., (Chou) in the above cited reference, reports interfacial reactions during the chemical interdiffusion between boron nitride and $Ni_3Al$ with concomitant formation of Kirkendall voids.

Benko, E., (Benko) reporting in the above cited reference on the study of BN-metal systems, determines that the metals react with boron nitride forming borides or mixtures of borides and nitrides.

In the course of the development toward the present invention, attempts at pressureless sintering of h-BN containing matrix composites under conditions of temperature, pressure and atmosphere commonly used to sinter the corresponding boron nitride-free matrix material invariably failed, resulting in segregation of boron-rich precipitates. For example, the usual sintering temperature for boron nitride-free 304L stainless steel is about 1350° C. but when attempting to sinter 304L matrix composites containing 5 weight percent of h-BN at that temperature, liquid phase exuded from the matrix.

From the foregoing description of the prior art, it can be gathered that the ability to extend the reach of Dunmead's invention to a wider range of materials, that would encompass pure metals, metal alloys, oxides, nitrides, carbides, including cemented carbides, and mixtures of these, as well as the ability to reach the high densities essential to ensure wear resistance by pressureless sintering would be desirable and innovative improvements. However, the fabrication by pressureless sintering of highly densified boron nitride containing materials having low coefficients of friction and wear rates is not known.

BRIEF SUMMARY OF THE INVENTION

In accordance with the present invention a method is provided to fabricate pressureless sintered, wear resistant, mechanically interacting articles from high density materials with intrinsic, unabradable slipperiness.

The invention consists of shaping green bodies from an intimate dispersion of substantially micrometer-sized particles of sinterable materials and deaggregated, submicrometer-sized crystalline hexagonal boron nitride powders in a thermoplastic binder, removing the organic binder from said green bodies and sintering the binder-free compacts to high densities under conditions of temperature and atmosphere that will not lead to the generation of deleterious amounts of precipitate or liquid phase.

OBJECTS AND ADVANTAGES

It is a primary object of this invention to provide a method to produce high density, wear resistant materials with intrinsic, unabradable slipperiness.

It is another object of this invention to provide a manufacturing process for parts from wear resistant, high density materials having low coefficients of friction.

Yet another object of the present invention is to provide a method to produce oil-less, uncoated, self-lubricating, frictionless, stiction-free contacts between parts in relative motion to each other.

Still another object of the present invention is to provide a manufacturing process for parts in frictional contact under heavy load bearing conditions.

A still further object of the present invention is to provide a method to fabricate wear resistant, high density matrix composites with intrinsic, unabradable slipperiness.

A still further object of the present invention is to provide a method to fabricate a duplex structure consisting of a high density, boron nitride-based matrix composite with low coefficient of friction and high wear resistance sinterbonded to a boron nitride-free material.

BRIEF DESCRIPTION OF THE SEVERAL VIEWS OF THE DRAWINGS

Not Applicable

DETAILED DESCRIPTION OF THE INVENTION

In the course of the development toward the present invention, boron-metal binary phase diagrams published in above-referenced ASM Handbook, Volume 3, and by above-referenced Center for Research in Computational Thermochemistry (CRCT) were examined.

Table 1 displays the melting point, eutectic temperature and corresponding boron weight percent for selected boron-metal systems.

TABLE 1

PROPERTIES OF SELECTED BORON-METAL SYSTEMS

| Metal | Symbol | Melting Point ° C. | Eutectic Temp. ° C. | Boron Content % weight |
|---|---|---|---|---|
| Chromium | Cr | 1907 | 1630 | 3.1 |
| Cobalt | Co | 1495 | 1110 | 4 |
| Copper | Cu | 1084 | 1013 | 2.5 |
| Iron | Fe | 1538 | 1161 | 3.7 |
| Manganese | Mn | 1246 | 1207 | 3 |
| Molybdenum | Mo | 2623 | 2168 | 2.9 |
| Nickel | Ni | 1455 | 1100 | 3.6-13.2 |
| Silicon | Si | 1414 | 1373 | 3.2 |
| Titanium | Ti | 1668 | 1530 | 1.5 |
| Zirconium | Zr | 1855 | 1680 | 2 |

From this tabulation it can be seen that in all these systems, the inclusion of a just few percent of boron depresses the liquidus, in some cases by several hundreds of degrees. Consequently, the generation of liquid phase observed during above mentioned failed attempts to sinter h-BN containing 304L matrix composites is likely due to the formation of iron, manganese or nickel borides either separately or in combination. On the other hand, lowering the sintering temperature below the eutectic temperature of these boron-metal systems tends to stifle densification. To elude these problems, the inventors elaborated a different and innovative processing avenue.

Dunmead's aforementioned optimum range of 2-5 weight percent of h-BN necessary to reduce the coefficient of friction by at least 20% for a concomitant reduction of not more than 10% of the yield strength of the base material is taken as a yardstick. Clearly, this optimum range must be expressed in volume percent if it is to be used for matrix materials with different densities. Among the hot pressable materials amenable to Dunmead's invention, copper has the highest density. Consequently, Dunmead's optimum range of 2-5 weight percent h-BN in pure copper equates to 7.2-16.7 volume percent or a volumetric ratio of h-BN to copper of about 7-20 percent. Since boron nitride contains 43.56 weight percent boron, the corresponding weight percent range of boron with respect to any particular constituent of the matrix material can be determined. For example, in a 304L stainless steel matrix containing say 14 weight percent nickel, Dunmead's optimum range of 7.2-16.7 volume percent of h-BN corresponds to 6.7-15.3 weight percent of boron with respect to the stainless steel's nickel content. From Table 1 it can be seen that the B—Ni system has a eutectic temperature of 1018° C. at a boron concentration of 10.7-13.2 weight percent with respect to nickel. Consequently, if compacts of 304L stainless steel containing 2-5 weight percent h-BN are heated to 1018° C., liquid phase resulting from the reaction of boron with nickel will likely be generated. Yet, at that temperature no significant densification occurs.

In such a context, the inventors of the present invention have conceived and developed a novel approach consisting of boosting the sintering kinetics so that densification will take place at reduced temperatures at which reactions with boron can be averted or contained. This objective is achieved by the combination of following procedural steps:

i. using raw matrix materials in microparticulate form. In the context of this invention, the term 'microparticulate' applies to particulate matter with an average equivalent diameter below 20 μm. Advantageously, the raw matrix materials shall be below 10 μm, ii. breaking down the hexagonal boron nitride aggregates into substantially primary crystallites and obstructing their reaggregation, iii. intimately mixing the microparticulate matrix materials and deaggregated hexagonal boron nitride with an organic thermoplastic binder to produce a molding compound which can be shaped into green parts, iv. removing the binder from said green parts and sintering the resulting binder-free compacts under conditions of temperature and atmosphere at which the formation of liquid phase will be averted or contained.

These procedural steps are now explained in detail.

The use of raw matrix materials in microparticulate form is an essential criterion in the successful application of the present invention. It is well known that a decrease in particle size results in enhanced sintering kinetics. When materials are in micrometer to submicrometer form, full densification is often possible at substantially lower temperatures than those needed for sintering coarse-grained particulates. This is because smaller particles imply shorter diffusion lengths while promoting boundary diffusion mechanisms. The use of smaller particles also leads to improved mechanical properties in the sintered products.

When microparticulate matrix materials are not commercially available, they may be produced by comminuting coarse powders via mechanical milling or attriting. The extent to which the coarse raw matrix materials should be comminuted depends on the nature of the materials, their initial particle size and the resulting sintering kinetics of the comminuted particles. The guiding principle to follow is that comminution should be pursued at least to the point where the ensuing enhanced sintering kinetics allow for the microparticulates to be pressureless sintered at temperatures below those at which deleterious reactions with boron nitride take place.

The raw constituents of the matrix material may be selected from the group of pure metals, metal alloys, oxides, nitrides, carbides, including cemented carbides, and mixtures of these. Clearly, they will be selected with a view into their suitability for the specific application or end product for which they are intended.

The next step in the application of the present invention is the procurement of hexagonal boron nitride (h-BN) powders, remembering that this generic nomenclature includes t-BN, m-BN and h-BN crystalline structures. All commercially available h-BN powders are agglomerates or aggregates (the terms agglomerates and aggregates are synonymous in this context) of primary crystallites. Because of the platelet nature of h-BN crystals, the size of the agglomerates is commonly expressed in terms of specific surface area. For example, Lelonis et al., (Lelonis) in above-cited reference, describes a t-BN powder with a specific surface area of 40 $m^2/g$ and a fully crystallized graphitic h-BN powder with a specific surface area of less than 8 $m^2/g$. Although any commercially available variant of h-BN powder can be used toward the successful application of this invention, preference will be given to very fine powders of high purity. Recently, fine-grained, high purity t-BN powders with improved sinterability over conventional fully crystallized graphitic h-BN powders have appeared on the market and may advantageously be used in the application of this invention. For instance, Yamamoto, U.S. Pat. No. 6,306,358 claims a process to produce a high purity crystalline t-BN powder with an average particle size of less than 0.1 μm and narrow particle size distribution.

The following step in the pursuance of the present invention is to break down the h-BN powder aggregates into substantially primary crystallites. This step is advantageously performed by mechanical milling or attrition in the presence of one or more suitable surfactants in order to impede reaggregation. The extent of deaggregation depends on the initial grain size of the h-BN powders and the ease with which they can be deaggregated. The minimum volume of surfactant to be adsorbed can be determined empirically on the basis of the specific surface area of the deaggregated h-BN powder.

The subsequent step in the pursuance of the present invention is to disperse the deaggregated, surfactant-coated h-BN particulates and optionally comminuted raw matrix microparticulates in a thermoplastic organic binder to produce a thermoplastic compound from which green parts can be shaped via prior art techniques such as casting, injection molding, laminating, extrusion, or the like. In a non-limiting variant of the present invention, the steps of comminuting the raw matrix materials, deaggregating and surfactant-coating the h-BN particulates and mixing the thermoplastic compound may advantageously be combined by applying the teachings of Billiet et al., U.S. Pat. No. 6,740,287.

Following extraction of the organic binder from the green parts, the substantially binder-free h-BN containing compacts are densified by pressureless sintering. Clearly, the sintering conditions will be adapted to the nature of the matrix material. Sintering of metal matrix composites is commonly carried out in a non-oxidizing atmosphere, generally vacuum or a gas such as argon or hydrogen, while oxide ceramic matrix composites may be sintered in an oxidizing or non-oxidizing atmosphere.

Advantageously, the sintering cycle may include a preheating step in hydrogen to 600-100° C. to ensure complete removal of residual organics and to reduce any oxides that can be reduced at these temperatures. The peak sintering temperature and any optional temperature dwells will be optimized for each specific matrix material so as to either completely avert the generation of liquid phase through reactions with boron nitride or to contain the amount of liquid phase generated in cases where liquid phase sintering is deemed beneficial to the densification.

While the specific embodiments of the invention will be elucidated mainly through the non-limiting examples given below and involve materials such as stainless steels, oxide ceramics and cemented carbides, the invention also applies to other metals, alloys, ceramics, cermets, and other sinterable materials.

Example I

A ceramic ball mill of 1 gallon capacity containing 3 mm diameter zirconia grinding balls was loaded with 166 g of h-BN grade B50 powder having a surface area of 6.5 $m^2/g$ from H. C. Starck, Inc., 36 g of phosphatidylcholine as a surfactant and 213 g of paraffin wax. Sufficient hexane was added to submerge the charge. The ball mill was sealed and spun at 250 rpm for 48 hours following which the slip was discharged, dried in air and granulated. The dried granules were then mixed in a twin screw extruder with 222 g of polypropylene and 3,170 g of gas atomized, Microfine™ grade 316L stainless steel powder from Sandvik Osprey Ltd, having an average particle size of 3.5 μm to yield a homogeneous feedstock. Green parts molded from this feedstock were dewaxed and sintered in hydrogen at 1200° C. for 6 hours. The sintered parts showed no structural defects and had a density, as determined by gas pycnometry, of 6.885 $g/cm^3$ or about 97.8% of the theoretical density. The dynamic coefficient of friction, measured on polished slabs of sintered parts was found to be 0.225 whereas the same measurement done on similarly polished slabs of the corresponding boron nitride-free sintered 316L material was 1.332. Thus, through the application of the present invention, the coefficient of friction had been reduced by about 83.1%. A drilling test was conducted on 5.6 mm thick sintered slabs using a 5 mm diameter carbide drill bit. After drilling just two holes, the drill bit was blunt to the point of being of no further use.

Example II

A slip was prepared as in Example I with the exception that 5,500 g of tungsten carbide powder containing 14% cobalt, grade WC-SD 0.8 μm from Treibacher Industrie AG was also added directly to the ball mill charge. The dried and granulated slip was mixed in a twin screw extruder together with 185 g of polypropylene to yield a homogeneous feedstock. Green parts molded from this feedstock were dewaxed in hydrogen at 600° C. then sintered in argon at 1250° C. at a partial pressure of 500 μm Hg for 6 hours. The sintered parts showed no structural defects or segregation and yielded a gas pycnometer density of 13.407 g/cm$^3$ or about 93.1% of the theoretical density.

Example III

As no commercial powder of TZM—a molybdenum alloy of nominal composition Mo-0.5Ti-0.1Zr—could be found in the market, bar stock and machining scrap were ground and ball milled under inert atmosphere into a powder with a particle size of 90% minus 50 μm and a specific surface area of 1.6 m$^2$/g. A 2.6 gallon zirconia-clad attritor made by Union Process, filled with 3.0 mm diameter zirconia grinding media was charged with 7,445 g of the comminuted TZM powder, 302 g of turbostratic boron nitride (t-BN) powder, grade A, having a specific surface area of 40 m$^2$/g from Momentive Performance Materials, Inc., and 65 g of phosphatidylcholine as a surfactant. The attritor was then filled with Vertrel MCA™, a solvent from DuPont, until the charge was completely submerged. Supernatant air was displaced from the installation by flushing with dry, purified argon for 30 minutes following which milling was started and allowed to proceed under argon blanket for 36 hours. Upon completion of the milling step, the solvent-powder slurry was pumped to the trough of a 4 gallon planetary mixer containing 617 g of polypropylene and 562 g of paraffin wax. Following evaporation of the solvent by maintaining the trough under a vacuum of 10 μm Hg, mixing was completed at 150° C. The resulting compound was cooled, granulated and molded into green parts which were dewaxed in hydrogen to 900° C. then sintered in vacuum at 1650° C. for 6 hours. The sintered parts showed no structural defects or segregation and yielded a gas pycnometer density of 8.471 g/cm$^3$ or about 94.2% of the theoretical density.

Example IV

A slip was prepared as in Example I with the exception that 2,224 g of spray dried zirconia powder stabilized with 3 mol Y203, grade TZ-3Y from Daiichi Kigenso K.K. Co., Ltd., having an average particle size of 0.3 μm and specific surface area of 14 m2/g was added directly to the ball mill charge. The dried and granulated slip was mixed in a twin screw extruder with 213 g of polypropylene to yield a homogeneous feedstock. Green parts molded from this feedstock were dewaxed and sintered in air at 1600° C. for 6 hours. The sintered parts showed no structural defects or segregation and yielded a gas pycnometer density of 4.980 g/cm$^3$ or about 97.1% of the theoretical density.

Example V

Applying the teachings of Billiet et al., U.S. Pat. No. 6,733,703, a molding feedstock of boron nitride-free 316L having a shrinkage factor upon sintering matching that of the feedstock used to produce the parts of Example I was prepared. Dewaxed green parts made from this feedstock were sintered contiguously with dewaxed green parts of Example I, applying only sufficient pressure to assure positioning and contact of the areas to be bonded by solid state diffusion. The resulting duplex structures displayed a strong diffusion bonded joint.

CONCLUSION, RAMIFICATIONS AND SCOPE

In conclusion, the major advantage of this invention resides in the ability to economically mass-produce commercial articles from high density, wear resistant and intrinsically slippery materials by pressureless sintering. Bearings, bushings and other articles subject to bearing loads made from these materials are substantially frictionless and stiction-free so that little if any heat of friction is generated.

The practical uses of the present invention are clearly broad in scope and universal in application and attempting to enumerate them all would not materially contribute to the description of this invention.

Although the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

We claim as our invention:

1. A method for producing a dense matrix composite material with intrinsic low coefficient of friction and high wear resistance, comprising:

a. providing at least one sinterable matrix material in particulate form with the particle diameter not exceeding 20 μm, b. providing a volume of hexagonal boron nitride in particulate form equal to 5-20% of the volume of said sinterable matrix material, c. deaggregating said hexagonal boron nitride and coating at least 25% of the surface of said deaggregated hexagonal boron nitride with at least one suitable surfactant to impede its reaggregation, d. dispersing said surfactant-coated, deaggregated hexagonal boron nitride and said sinterable matrix material in an organic thermoplastic binder to form a homogeneous moldable compound, e. shaping green bodies from said moldable compound and extracting substantially all of said organic thermoplastic binder from said green bodies, f. sintering said binder-free green bodies into dense bodies at temperatures at which any liquid phase generated during sintering does not impair the integrity of the sintered bodies.

2. The method as set forth in claim 1 wherein said sinterable matrix material is selected from the group of metals and metal alloys, oxides, nitrides, carbides, including cemented carbides, and mixtures thereof.

3. The method as set forth in claim 2 wherein the sintering temperature is maintained below that at which any liquid phase generated during sintering will adversely affect the integrity of the sintered bodies.

4. The method as set forth in claim 3 wherein reduction of the particle diameter of said sinterable matrix material results in faster sintering kinetics.

5. The method as set forth in claim 3 wherein the particle diameter of said sinterable matrix material does not exceed 10 μm.

6. The method as set forth in claim 3 further comprising milling said sinterable matrix material into particulate form with the particle diameter not exceeding him 1 μm.

7. The method as set forth in claim 3 wherein said sinterable matrix material contains nickel.

8. The method as set forth in claim 3 wherein said hexagonal boron nitride is turbostratic boron nitride.

9. The method as set forth in claim 3 wherein said hexagonal boron nitride is mesographitic boron nitride.

10. The method as set forth in claim 3 wherein said hexagonal boron nitride is graphitic boron nitride.

11. The method as set forth in claim 3 wherein the particle diameter of said hexagonal boron nitride does not exceed 1 μm.

12. Articles produced from materials obtained via the method as set forth in claim 3.

13. The articles as set forth in claim 12 wherein said articles are bearings, bushings or other articles subjected to bearing loads.

14. A solid state diffusion bonded duplex structure consisting of the particulate matrix material sinter bonded to the boron nitride composite material obtained via the method as set forth in claim 3.

* * * * *